US006460619B1

(12) United States Patent
Braithwaite et al.

(10) Patent No.: US 6,460,619 B1
(45) Date of Patent: Oct. 8, 2002

(54) METHOD AND APPARATUS FOR CREATION AND ISOLATION OF MULTIPLE FRACTURE ZONES IN AN EARTH FORMATION

(75) Inventors: Stephen Richard Braithwaite, St. George (CA); Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/724,073

(22) Filed: Nov. 28, 2000

(30) Foreign Application Priority Data

Nov. 29, 1999 (EP) ..... 99204023

(51) Int. Cl.[7] ..... E21B 43/267; E21B 33/124
(52) U.S. Cl. ..... 166/259; 166/191; 166/308
(58) Field of Search ..... 166/259, 285, 166/202, 179, 181, 191, 308

(56) References Cited

U.S. PATENT DOCUMENTS

| | | | | |
|---|---|---|---|---|
| 2,927,638 A | | 3/1960 | Hall, Sr. | |
| 2,986,214 A | * | 5/1961 | Wiseman, Jr. et al. | 102/310 |
| 3,028,914 A | * | 4/1962 | Flickinger | 166/284 |
| 3,220,475 A | | 11/1965 | Brandon | |
| 3,289,762 A | * | 12/1966 | Schell et al. | 166/281 |
| 5,005,649 A | * | 4/1991 | Smith et al. | 166/177.5 |
| 5,417,284 A | * | 5/1995 | Jones | 166/280 |
| 5,934,377 A | * | 8/1999 | Savage | 166/281 |
| 5,947,200 A | * | 9/1999 | Montgomery | 166/281 |
| 5,964,289 A | * | 10/1999 | Hill | 166/250.1 |
| 6,186,236 B1 | * | 2/2001 | Cox | 166/177.5 |

FOREIGN PATENT DOCUMENTS

WO WO 98/19042 7/1998

OTHER PUBLICATIONS

International Search Report of Feb. 26, 2001.

* cited by examiner

*Primary Examiner*—David Bagnell
*Assistant Examiner*—Brian Halford

(57) ABSTRACT

Following fracturing operations in a first zone of a well bore traversing an earth formation, a sealing assembly is lowered into the well bore to isolate the first zone from the remainder of the wellbore. The sealing assembly includes a reaction plate that rests on gravel within the borehole, a support strut having one end attached to the reaction plate with an elastomeric sealing member attached to the other end of the strut. The strut provides support for the sealing member and prevents it from being dislodged during subsequent fracturing operations. The sealing assembly is lowered downhole utilizing a mechanical running tool capable of running and retrieving the sealing assembly. A second zone in the well bore may then be subjected to fracturing operations without affecting the fractures in the first zone. A second sealing assembly, similar to the first sealing assembly, less reaction plate, may then be lowered by a running tool and attached to the top of the first sealing assembly to isolate the second zone. The fracturing/isolation process may be repeated to create and isolate multiple facture zones.

8 Claims, 3 Drawing Sheets

METHOD AND APPARATUS FOR CREATION AND ISOLATION OF MULTIPLE FRACTURE ZONES IN AN EARTH FORMATION

The present invention relates to a method of creating multiple fractures in an earth formation surrounding a wellbore formed in the earth formation. It is general practice to create such fractures to stimulate hydrocarbon fluid production from the earth formation, or to provide a flow path for injection fluid. In many instances the formation is to be fractured at different depth levels along the wellbore, for example in case hydrocarbon fluid is to be produced from earth layers at different along hole distances. A normal procedure for creating fractures is to perforate the wellbore casing at the required depth and to pump fracturing fluid into the formation via the casing perforations. Thereafter the fractures are subjected to treatment process, for example by pumping an acid into the fractures, or pumping propant material into the fractures in order to prevent closure of the fractures. A problem arises in case after treatment of the fractures created at a first location, fracturing fluid is pumped into the wellbore in order to create fractures at a second location since any penetration of fracturing fluid into the fractures at the first location will negatively affect the treatment results of such fractures.

Accordingly it is an object of the invention to provide a method of creating multiple fractures in an earth formation surrounding a wellbore, whereby earlier created fractures are not negatively affected by the creation of later fractures.

In accordance with the invention there is provided a method of creating multiple fractures in an earth formation surrounding a wellbore formed in the earth formation, the method comprising

- sealing a first section of the wellbore from the remainder of the wellbore by arranging a primary seal assembly in the wellbore, the first section containing a first body of fluid and being located between the primary seal assembly and the wellbore bottom;
- pressurising the first body of fluid so as to fracture the earth formation surrounding the first section;
- sealing a second section of the wellbore from the remainder of the wellbore by arranging a secondary seal assembly in the wellbore uphole the primary seal assembly, the second section containing a second body of fluid and being located between the secondary seal assembly and the primary seal assembly;
- supporting the primary seal assembly by a first support member extending between the primary seal assembly and the wellbore bottom; and
- pressurising the second body of fluid so as to fracture the earth formation surrounding the second wellbore section.

By supporting the primary seal assembly relative to the wellbore bottom it is achieved that the second wellbore section is adequately sealed from the fractures created around the first wellbore section.

The invention will be described further in more detail and by way of example with reference to the accompanying drawings in which FIG. 1 schematically shows a wellbore formed in an earth formation during a first stage of operation of an embodiment of the method of the invention;

Figure 1:
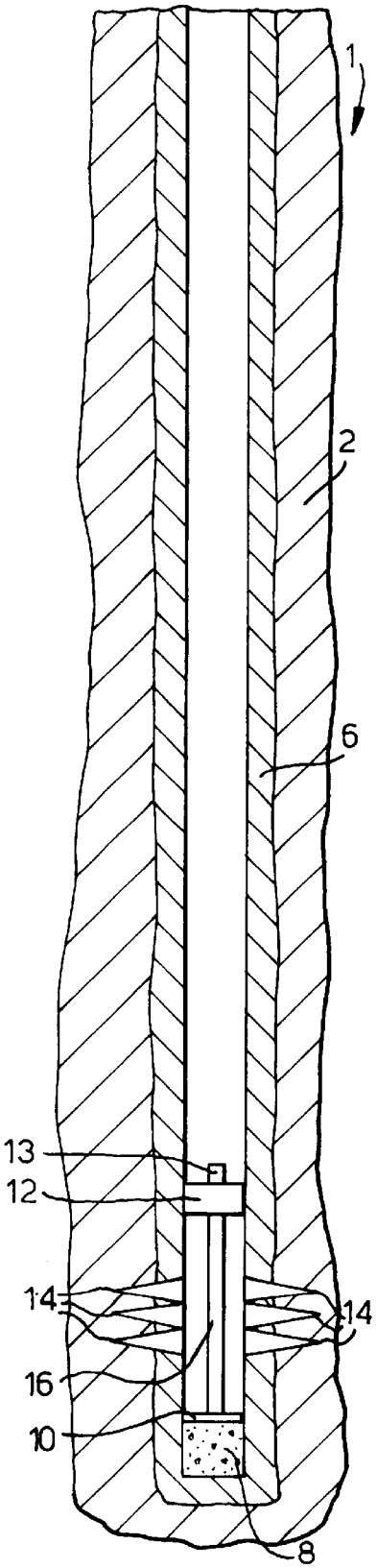
Figure 4:
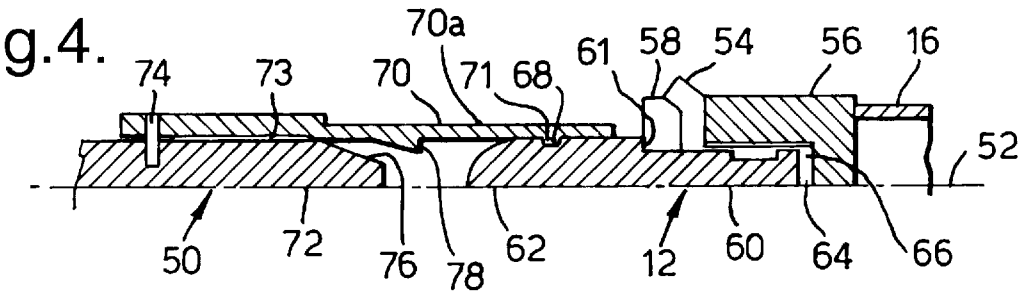
Figure 5A:
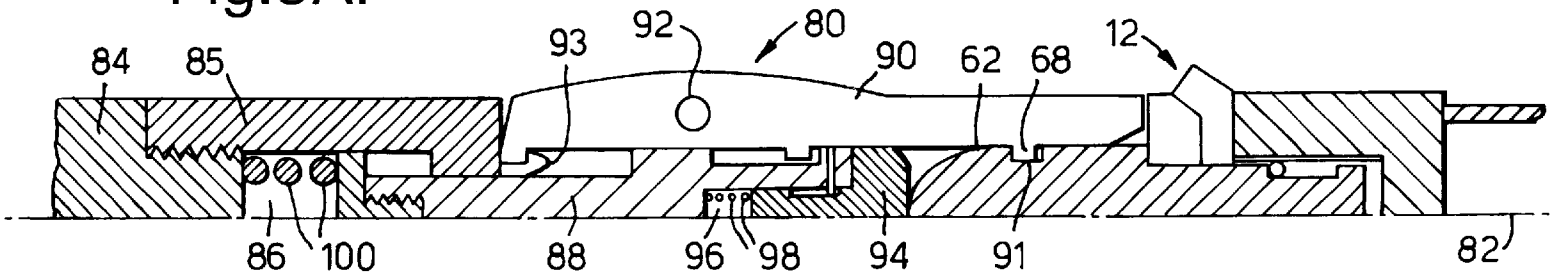
Figure 5B:
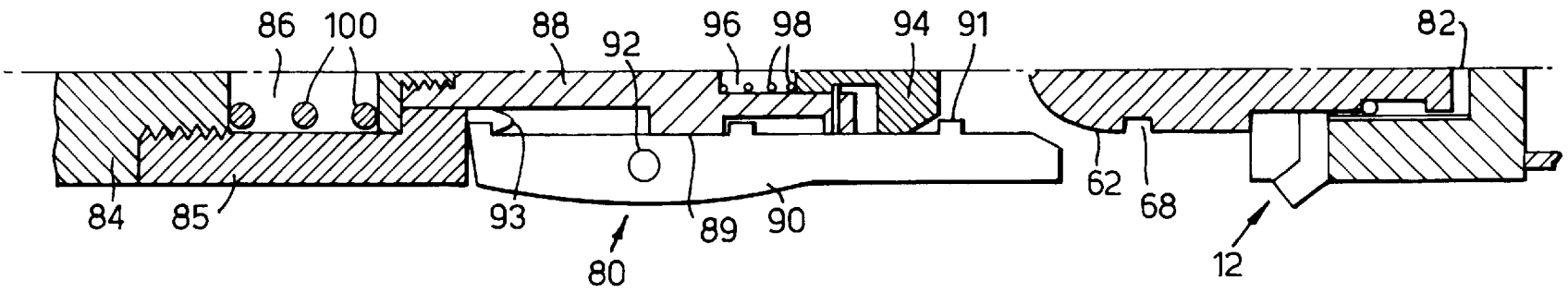

FIG. 4 schematically shows a running tool for running a seal assembly used in the embodiment of FIG. 1; and FIG. 5A schematically shows a retrieving tool in a first mode of operation, for retrieving the seal assembly of FIG. 4; and FIG. 5B schematically shows the retrieving tool of FIG. 5A in a second mode of operation.

Referring to FIG. 1 there is shown a wellbore 1 formed in an earth formation 2 during a first stage of operation, the wellbore being provided with a tubular casing 4 cemented in the wellbore 1 by a layer of cement 6. A body of gravel particles 8 covered by a reaction plate 10 is arranged in the lower end part of the wellbore 1. A primary seal assembly 12 is sealingly arranged in the casing 4 at a selected level above the reaction plate 10, the primary seal assembly being provided with a running/retrieving device 13 and being supported by a first support strut 16 extending between the primary seal assembly 12 and the reaction plate 10. A set of primary fractures 14 is formed in the earth formation at a level between the reaction plate 10 and the primary seal assembly 12.

Figure 2:
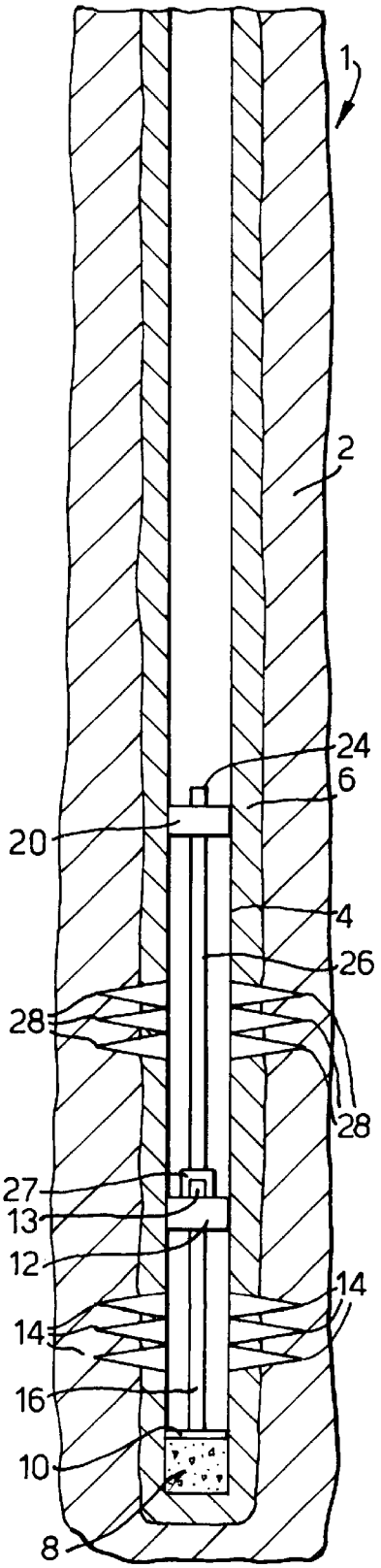
FIG. 2 shows the wellbore of FIG. 1 during a second stage of operation.

In FIG. 2 is shown the wellbore 1 during a second stage of operation, whereby a secondary seal assembly 20 is sealingly arranged in the casing 4 at a selected level above the primary seal assembly 12. The secondary seal assembly 20 is provided with a running/retrieving device 24 and is supported by a second support strut 26 extending between the secondary seal assembly 20 and the primary seal assembly 12, the second support strut 26 at the lower end thereof being provided with a protector cap 27 fitting over the running/retrieving device 13. A set of secondary fractures 28 is formed in the earth formation at a level between the primary seal assembly 12 and the secondary seal assembly 20.

Figure 3:
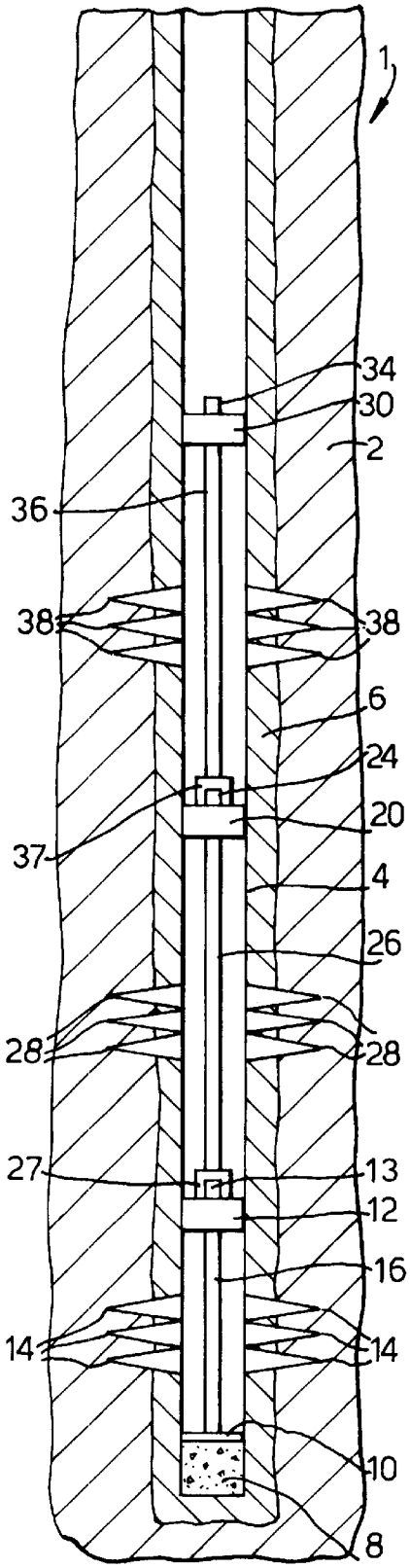
FIG. 3 shows the wellbore of FIG. 1 during a third stage of operation.

In FIG. 3 is shown the wellbore 1 during a third stage of operation, whereby a tertiary seal assembly 30 is sealingly arranged in the casing 4 at a selected level above the secondary seal assembly 20. The tertiary seal assembly 30 is provided with a running/retrieving device 34 and is supported by a third support strut 36 extending between the tertiary seal assembly 30 and the secondary seal assembly 20, the third support strut 36 at the lower end thereof being provided with a protector cap 37 fitting over the running/retrieving device 24. A set of tertiary fractures 38 is formed in the earth formation at a level between the secondary seal assembly 20 and the tertiary seal assembly 30.

In FIG. 4 is shown in more detail the primary seal assembly 12 with a running tool 50 attached thereto, the running tool and primary seal assembly having longitudinal axis of symmetry 52. The primary seal assembly 12 includes a cup-shaped elastomeric seal 54 biased between a body 56 and a plate 58. The running/retrieving device 13 includes a bolt 60 screwed into a threaded bore 64 of the body 56, the bolt 60 having a shoulder 61 biasing the circular plate 58 against the elastomeric seal 54. The bolt 60 has a hexagonal head 62. A spacer 66 of selected thickness is arranged between the bolt 60 and the bottom of the bore 64. The hexagonal head 62 is provided with an annular groove 68. The running tool 50 includes a hexagonal socket 70 having radially movable fingers 70*a* provided with dogs 71 fitting into the groove 68, and a shaft 72 fitting into the socket 70 and being connected thereto by a threaded connection 73 and a plurality of shear pins 74. The shaft 72 has a tapered end part 76, and the fingers have inwardly extending socket tapers 78. The first support strut 16 is fixedly connected to the body 56.

The secondary and tertiary seal assemblies 20, 30 are similar to the primary seal assembly 12.

Referring to FIGS. 5A, 5B there is shown in more detail the primary seal assembly 12 together with a retrieving tool 80, the retrieving tool 80 and primary seal assembly 12 having longitudinal axis of symmetry 82. The retrieving tool 80 includes a shaft 84 provided with a shaft extension 85 having a bore 86 into which a spool 88 extends, the spool 88 having an annular lock surface 89 and being slideable in longitudinal direction relative to the shaft extension 85 between an extended position (shown in FIG. 5A) and a retracted position (shown in FIG. 5B). The retrieving tool 80 furthermore includes a plurality of fingers 90 (only one of which is shown) rotatable about pins 92, each finger 90 being provided with a dog 91 fitting into the groove 68. The fingers 90 are biased to a radially inward rotational position by spring elements 93. The location of each pin 92 relative to the spool 88 is such that the annular lock surface 89 allows radially outward hinging of the fingers 90 when the spool 88 is in the extended position, and prevents radially outward hinging of the fingers 90 when the spool 88 is in the retracted position. The spool 88 is provided with a nose section 94 extending into a bore 96 of the spool 88 and being slideable in longitudinal direction relative to the spool 88. A first compression spring 98 is arranged in the bore 96, the spring 98 biasing the nose section 94 in the direction of the hexagonal head 69 of the seal assembly 12. A second compression spring 100 is arranged in the bore 86, the spring 100 biasing the spool 88 biasing each finger to a radially inward position thereof.

During normal operation the wellbore 1 is drilled and the casing 4 is cemented in the wellbore 1. The casing 4 is then perforated and fracturing fluid is pumped into the wellbore so as to create the set of primary fractures 14, whereafter propant is pumped into the fractures 14.

The body of gravel particles 8 is then formed from residual propant deliberately left in the wellbore 1. Next the primary seal assembly 12 with the first support strut 16 and reaction plate 10 connected thereto is lowered into the casing 4 until the reaction plate 10 contacts the body of gravel particles 8. The primary seal assembly is then activated (as described hereinafter) so as to seal against the inner surface of the casing 4

In a next step fracturing fluid is pumped into the wellbore so as to create the set of secondary fractures 28, whereafter propant is pumped into the fractures 28. During fracturing the first support strut 16 prevents the primary seal assembly 12 from being laterally displaced. The secondary seal assembly 20 with the second support strut 26 connected thereto is then lowered into the casing 4 until the second support strut contacts the primary seal assembly 20 whereby the protector cap 27 fits over the running/retrieving device 13. Next, the secondary seal assembly is activated (as described hereinafter) so as to seal against the inner surface of the casing 4.

In a further step fracturing fluid is pumped into the wellbore so as to create the set of tertiary fractures 38, whereafter propant is pumped into the fractures 38. During fracturing the second support strut 26 prevents the secondary seal assembly 20 from being laterally displaced. The tertiary seal assembly 30 with the third support strut 36 connected thereto is then lowered into the casing 4 until the third support strut contacts the secondary seal assembly 20 whereby the protector cap 37 fits over the running/retrieving device 24. The tertiary seal assembly 30 is then activated (as described hereinafter) so as to seal against the inner surface of the casing 4.

The primary seal assembly 12 is activated in the following manner. The running tool 50 is lowered onto the bolt 60 whereby the socket fingers 70*a* move over the hexagonal head 62 until the dogs 71 latch into groove 68. The bolt 60 is subsequently rotated in right hand direction by rotating the running tool 50, thereby compressing the elastomeric seal against the inner surface of the casing 4. Rotation is continued until the bolt 60 becomes biased against the spacer 66. Rotation is then continued so that the shear pins 74 are sheared-off and the shaft 72 moves inwardly relative to the socket 70 by virtue of threaded connection 73. Upon continued rotation the tapered end part 76 contacts the socket tapers 78 thereby moving the fingers 70*a* radially outward and unlatching the dogs 71 from the groove 68. The running tool 50 is then retrieved to surface.

After finalising the fracturing procedure, the tertiary seal assembly 30 is first retrieved, followed by retrieval of the secondary seal assembly 20 and the primary seal assembly 12. Each seal assembly is retrieved in the following manner. The retrieving tool 80 is lowered through the wellbore, whereby the spool 88 is biased to its extended position by spring 100. Upon contact with the bolt 60, the nose section 94 first moves towards the spool against the force of spring 98 and then pushes the spool 88 towards its retracted position against the force of the spring 100. Simultaneously the fingers 90 are rotated radially outward by virtue of their contact with the bolt 60 until the dogs 91 latch into the groove 68, thereby allowing the spring elements 93 to rotate the fingers 90 back radially inward. With the dogs 91 latched into the groove 68, the spool 88 has reached its retracted position in which the annular lock surface 89 prevents radially outward hinging of the fingers 90. Torque is then applied to the shaft 84 so as to rotate the bolt 60 in left hand direction thereby deactivating the elastomeric seal 54. The seal assembly 12, 20, 30 is then retrieved to surface.

What is claimed is:

1. A method of creating multiple fractures in an earth formation surrounding a wellbore formed in the earth formation, the method comprising (a) sealing a first section of the wellbore from the remainder of the wellbore by arranging a primary seal assembly in the wellbore, the primary seal assembly including a support member in the wellbore extending between the primary seal assembly and the well bottom, the first section containing a first body of fluid and being located between the primary seal assembly and the wellbore bottom;

(b) pressurising the first body of fluid so as to fracture the earth formation surrounding the first section;

(c) sealing a second section of the wellbore from the remainder of the wellbore by arranging a secondary seal assembly in the wellbore uphole of the primary seal assembly, the secondary seal assembly including a support member in the wellbore extending between the primary seal and the secondary seal, the second section containing a second body of fluid and being located between the secondary seal assembly and the primary seal assembly; and (d) pressurising the second body of fluid so as to fracture the earth formation surrounding the second wellbore section.

2. The method of claim 1, wherein the first support member is supported against at least one of the wellbore bottom and a body of solid particles arranged between the support member and the wellbore bottom.

3. The method of claim 2, wherein the body of solid particles is selected from a body of propant particles and a body of gravel particles.

4. The method of claim 3, wherein a reaction plate is arranged between the first support member and the body of solid particles.

5. The method of claim 4, further comprising (a) sealing a third section of the wellbore from the remainder of the wellbore by arranging a tertiary seal assembly in the wellbore uphole the secondary seal assembly, the tertiary seal assembly including a support member in the wellbore extending between the secondary seal and the tertiary seal, the third section containing a third body of fluid and being located between the tertiary seal assembly and the secondary seal assembly; and (b) pressurising the third body of fluid so as to fracture the earth formation surrounding the third wellbore section.

6. The method of claim 5, wherein each support member includes a support strut.

7. The method of claim 6, wherein each seal assembly includes a cup-shaped elastomeric seal compressed between solid compression elements.

8. The method of claim 7, wherein the wellbore further includes a tubular element and wherein each seal assembly is sealed against the inner surface of the tubular element.

* * * * *